US009435147B1

(12) United States Patent
Giandomenico, Jr. et al.

(10) Patent No.: US 9,435,147 B1
(45) Date of Patent: Sep. 6, 2016

(54) EMERGENCY BARRICADE SYSTEM

(71) Applicants: Thomas Anthony Giandomenico, Jr., San Dimas, CA (US); Jeffrey Russell Coates, Torrance, CA (US)

(72) Inventors: Thomas Anthony Giandomenico, Jr., San Dimas, CA (US); Jeffrey Russell Coates, Torrance, CA (US)

( * ) Notice: Subject to any disclaimer, the term of this patent is extended or adjusted under 35 U.S.C. 154(b) by 185 days.

(21) Appl. No.: 14/246,112

(22) Filed: Apr. 6, 2014

Related U.S. Application Data

(60) Provisional application No. 61/811,218, filed on Apr. 12, 2013.

(51) Int. Cl.
*E05C 1/08* (2006.01)

(52) U.S. Cl.
CPC ..... *E05C 1/085* (2013.01)

(58) Field of Classification Search
CPC ..... Y10T 292/0999; Y10T 292/0869; Y10T 292/0893; E05B 15/101; E05B 2047/0086; E05B 15/102; E05B 53/001
USPC ..... 292/177–182
See application file for complete search history.

(56) References Cited

U.S. PATENT DOCUMENTS

| | | | | | |
|---|---|---|---|---|---|
| 1,768,326 | A * | 6/1930 | Miller | E05C 17/446 | 292/153 |
| 4,066,284 | A * | 1/1978 | Ikemura | E05C 1/04 | 292/62 |
| 4,792,167 | A * | 12/1988 | King | E05B 39/025 | 292/148 |
| 5,746,455 | A * | 5/1998 | Takimoto | E05C 1/04 | 292/145 |
| 2007/0204662 | A1* | 9/2007 | Pullmann | E05B 15/101 | 70/277 |
| 2014/0175811 | A1* | 6/2014 | Fu | E05C 1/04 | 292/179 |
| 2014/0265363 | A1* | 9/2014 | Mock | E05B 53/001 | 292/177 |

* cited by examiner

*Primary Examiner* — Mark Williams
(74) *Attorney, Agent, or Firm* — Melanius D'Souza

(57) ABSTRACT

An Emergency Barricade System (EBS) to protect children in school shootings from harm-doers is disclosed. The EBS comprises a Quickly Activated Bolt Latch (QABL) and an Unlocking Tool (UT). The QABL is attached to the inside surface of a classroom door. In an emergency, the bolt of the QABL can be quickly slid into a bolt-hole by foot pressure. The bolt is held in place in the bolt-hole by a locking means in the QABL. The bolt can be easily unlocked by pressing on a release pin on the QABL. A spring is provided in the QABL to automatically return the bolt to its normal position. An Unlocking Tool is provided to enable rescuers to unlock the QABL from outside the classroom.

21 Claims, 8 Drawing Sheets

EMERGENCY BARRICADE SYSTEM

RELATED APPLICATIONS

This application claims priority from U.S. Provisional Application No. 61/811,218 filed on Apr. 12, 2013.

FIELD OF THE INVENTION

This invention relates to an Emergency Barricade System (EBS) to protect potential victims from harm-doers. It essentially comprises a Quickly Activated Bolt Latch (QABL) and an Unlocking Tool to unlock the locked bolt latch from the exterior of the barricaded area by rescuers. The QABL is a door bolt lock system that can be hastily locked by foot in a crisis and also can be unlocked by foot without a key or without having to search for the lock.

BACKGROUND OF THE INVENTION

Tragic situations such as the school shootings in Newtown, Conn. and Columbine, Colo. have taken place over the past few years in this country. Many young lives have been lost in these tragedies because the shooter had unfettered access to his victims. In such situations, many lives would have been saved if the victims had been able to quickly and easily barricade themselves in their class-rooms or other secure areas.

The EBS described below provides protection to potential victims who might find themselves in a dangerous situation and need to barricade themselves from persons who may desire to do them harm.

SUMMARY OF THE INVENTION

The embodiment of the Emergency Barricade System (EBS) described herein comprises a Quickly Activated Bolt Latch (QABL) and an Unlocking Tool (UT).

The QABL comprises a casing with a longitudinally oriented bore which is open at least at one end. The casing has a means for attaching to a door, with the open end of the bore generally aligned with the edge of the door. A sliding element (SE) is located within the casing. The SE closely fits within the bore of the casing and has a first end and a second end. The SE is capable of being slidingly positioned within the bore in a first (disengaged) position or in a second (engaged) position. In the engaged position, the first end of the SE protrudes through the open end of the bore to engage a matching bolt-hole in the floor or door frame. During normal times, the SE is held in the disengaged position by a spring means. At times of crisis, the SE can be rapidly moved from the disengaged position to the engaged position against the action of the spring means by downwards pressure from the user's foot. The SE is held in its engaged position by a locking means. When the crisis is over, the SE is released from its engaged position by an unlocking means. When the SE is released, the spring means returns the SE to the disengaged position.

In the embodiment of the Emergency Barricade System (EBS) described herein, the bore of the QABL has a second open end which protrudes out of the second open end when the SE is in the disengaged position. A foot pedal is attached to the second end of the SE to move it quickly from the disengaged position to the engaged position against the action of the spring means. The spring means to hold the SE of the QABL in the disengaged position is a partially compressed helical spring positioned around the sliding element between the second open end of the bore of the casing and the foot pedal. The spring is generally fully compressed when the foot pedal is pressed.

In the embodiment of the Emergency Barricade System (EBS) described herein, the locking means to lock the SE in place when it is in the engaged position comprises a toggle bar and a spring which is located in a longitudinal cavity in the SE. The toggle bar is pivotingly attached at its first (lower) end within the cavity. The spring maintains the second (free) end of the toggle bar in sliding contact with the inside surface of the bore. The bore has an engaging surface to hold the toggle bar in a swung out position to arrest the SE in an engaged position and prevent the spring means from returning the SE to the disengaged position.

Further in the embodiment of the Emergency Barricade System (EBS) described herein, the unlocking means to unlock the SE from the engaged position comprises a release pin which is located in a pin-hole in the casing of the QABL. The pin-hole is located over the free end of the toggle bar when the SE is in an engaged position. The release pin slidingly fits and partially protrudes out of the pin-hole in the casing. When the protruding end of the pin is pressed, the pin pushes the second end of the toggle bar past the engaging surface within the bore to release the SE from its engaged position. A spring means is provided to return the release pin to its partially protruding position within the pin-hole in the casing after it has been pressed to release the SE of the QABL from its engaged position. As an option, a toggle lever is provided in contact with the protruding end of the release pin to facilitate the pressing of the release pin.

The EBS described herein further comprises an Unlocking Tool (UT) means to unlock the QABL from outside the room. The UT means is configured as a flat bar having a crook at its insertion end to engage the unlocking means of the QABL. The flat bar is thin enough to be inserted in the gap between the closed door and the doorframe or floor.

DETAILED DESCRIPTION

The Emergency Barricade System (EBS) described herein comprises a Quickly Activated Bolt Latch (QABL) 100 and an Unlocking Tool 200 to unlock the bolt latch from the exterior of the barricaded area by rescuers. The QABL can be quickly and easily activated to safeguard persons who are in a potentially threatened position.

FIGS. 1A, 1B, 1C, 2A, 2B, and 3 represent an embodiment of the Quickly Activated Bolt Latch (QABL) 100, which is disclosed herein.

Figure 1A:
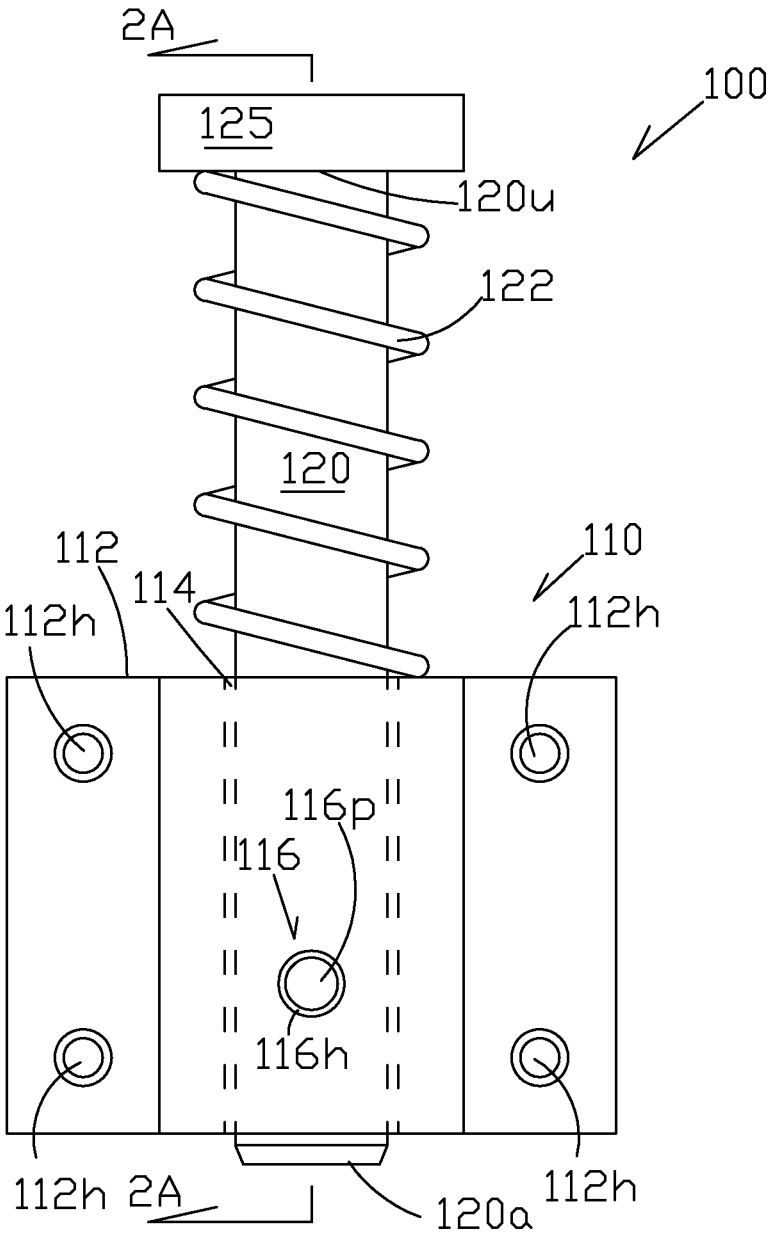
FIG. 1A is a plan-view representation of the Quickly Activated Bolt Latch (QABL) in a disengaged position.

QABL 100 comprises a casing 110 with a longitudinally oriented cylindrical bore 114 through which a sliding element shown as bolt 120 (described further below) is located. Further, casing 110 has a means, which is shown in FIG. 1A as base 112 with mounting holes 112*h*, to attach the casing to a door. Base 112 can be attached to a door with screws through mounting holes 112*h*. Ideally, casing 110 is attached to the lower edge of the door. In this position, bolt 120 engages a mating bolt-hole located in the floor or door-frame when the lower portion of bolt 120 is slid out of casing 110 (as described further below). This action secures the door firmly in a closed position Bore 114 is generally cylindrical throughout its length except that it has an internal longitudinally oriented square or rectangular cross-sectioned slot 115 (see FIGS. 2A, 2B, and 3) in its lower section to accommodate a locking means for locking the bolt 120 in the engaged position with the bolt-hole. The locking means is shown as catch mechanism 124 (described below) on bolt 120. Slot 115 also creates step 115*s* within bore 114 which engages catch mechanism 124 as will be described below. Slot 115 is created by machining a square or rectangular channel of desired length longitudinally within the inside cylindrical surface of the lower section of bore 114.

Further, an unlocking means 116 is provided on casing 114. The unlocking means comprises a cylindrical pin-hole 116*h* in casing 110 and release pin 116*p*. Cylindrical pin-hole 116*h* is provided at a generally perpendicular orientation to slot 115 of casing 110. Pin-hole 116*h* is designed to contain release pin 116*s*, which will be described below.

Bolt 120 is a cylindrical member about 0.75 inch in diameter and about 7 inches long which slidingly fits within bore 114. Groove 120*g* (see FIGS. 2A and 2B) is provided in the lower section of bolt 120 to house catch mechanism 124. Catch mechanism 124 comprises a toggle-bar 124*r* which is pivotingly attached at its first end 124*r*1 within groove 120*g* by pin 124*p*. Spring 124*s* is provided to bias second end 124*r*2 of toggle-bar 124*r* outwards from groove 120*g*. Thus toggle-bar 124*r* pivots around pin 124*p* and normally is biased such that its second (free) end 124*r*2 swings out of groove 120*g* until it is mechanically forced back into groove 120*g*.

Figure 2A:
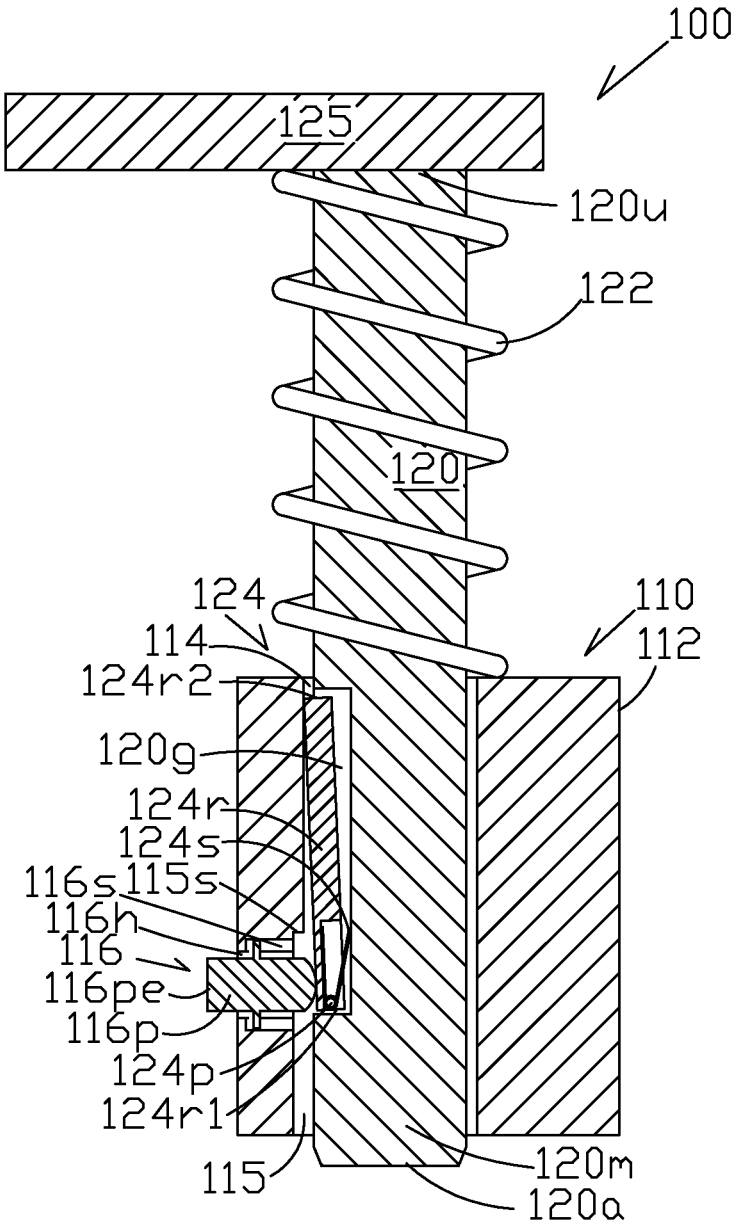
FIG. 2A is a cross-sectional view representation of the QABL in a disengaged position.
Figure 2B:
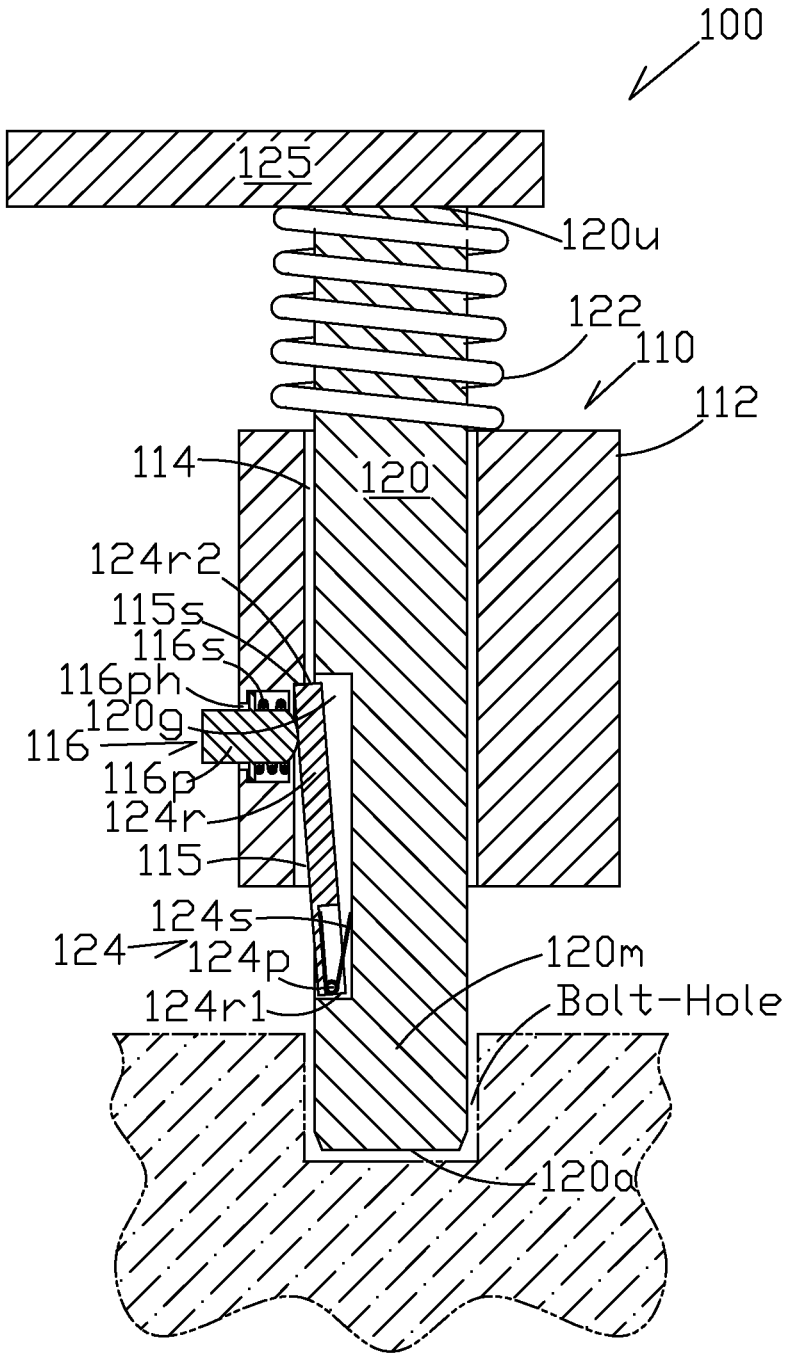
FIG. 2B is a cross-sectional view representation of the QABL in an engaged position.
Figure 3:
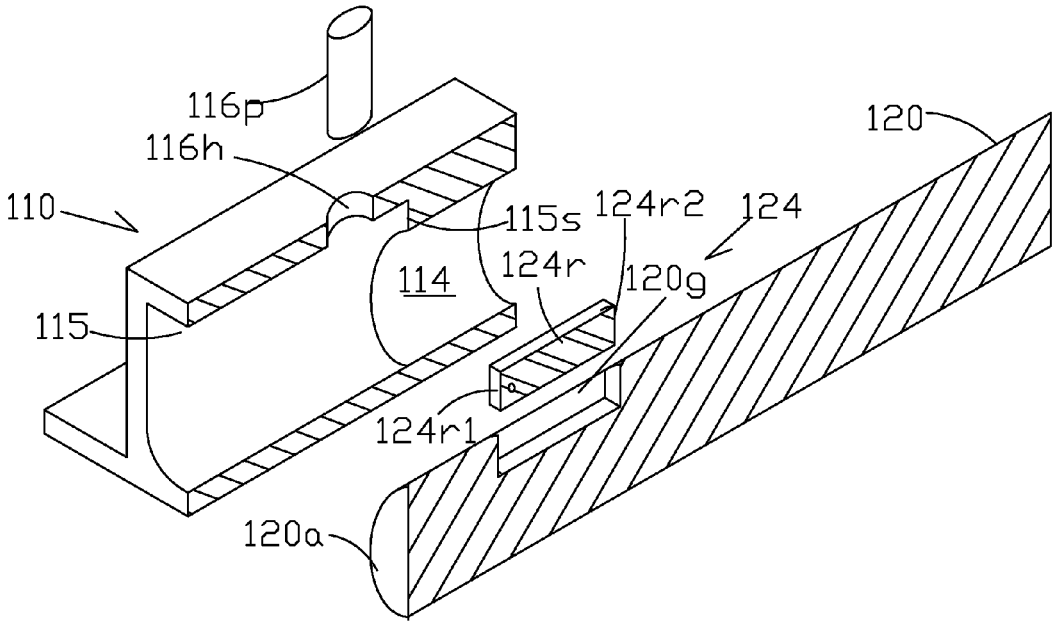
FIG. 3 is a three-dimensional exploded view representation of part of the QABL showing the internal details of the locking mechanism.

A foot pedal 125 is attached to the upper end 120*u* of bolt 120. To keep bolt 120 in a normally disengaged position, helical spring 122 is provided around bolt 120 between foot pedal 125 and casing 110. In the uncompressed position, spring 122 pushes bolt 120 upwards to its normally disengaged position as shown in FIGS. 1A and 2A. When foot pedal 125 is pressed down, bolt 120 is pushed down further into bore 114 such that its lower end 120*a* extends out of casing 110 to engage the bolt-hole as shown in FIG. 2B.

Figure 1B:
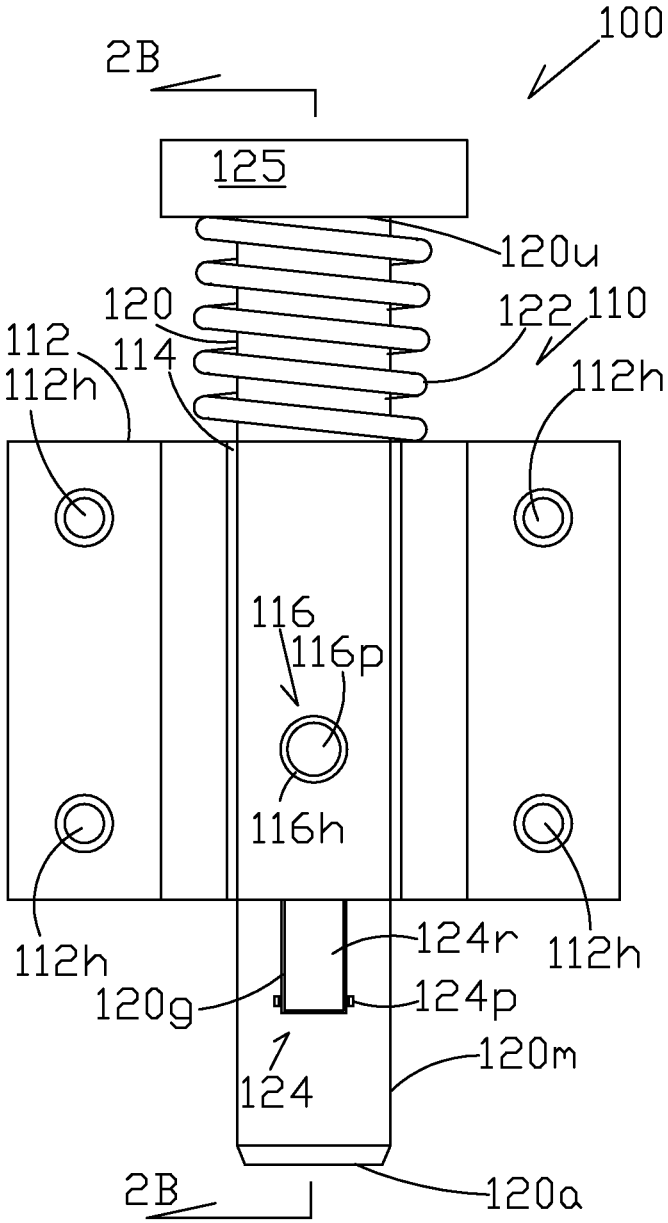
FIG. 1B is a plan-view representation of the QABL in an engaged position.
Figure 1C:
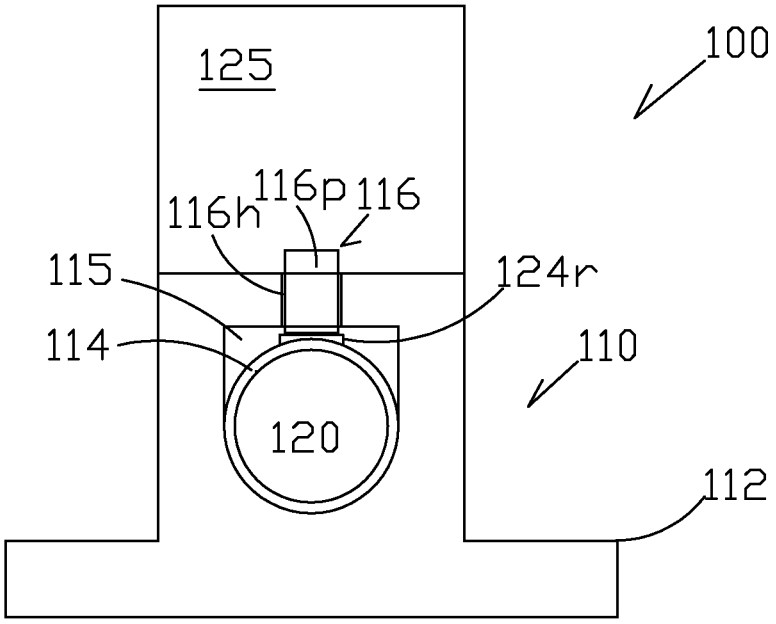
FIG. 1C is an end-view representation of the QABL.

To operate QABL 100, the door is closed so that bolt 120 is located over the bolt-hole. Bolt 120 of QABL 100 is now in the disengaged position shown in FIGS. 1A and 2A. The user then presses foot pedal 125 using his/her foot to move foot pedal 125 and attached bolt 120 towards the bolt-hole against the reactive force of spring 122 which is now compressed as shown in FIGS. 1B and 2B. The relative lengths and positions of slots 115 and toggle-bar 124*r* are designed such that when lower end 120*a* of bolt 120 is sufficiently inserted (e.g. 2.5 inches) into the bolt-hole, toggle-bar 124*r* is automatically released from its confined position (shown in FIGS. 1A and 2A) within the upper cylindrical section of bore 114. In this unconfined position (shown in FIGS. 1B and 2B), the free end 124*r*2 of toggle-bar 124*r* automatically swings out into slot 115 of bore 114 due to the action of spring 124*s*. When the user takes his/her foot off foot pedal 125, the reactive force of spring 122 pushes foot pedal 125 and attached bolt 120 upwards. Since toggle-bar 124*r* now is in a swung out position within slot 115 of bore 114, it engages step 115*s* (shown in FIGS. 1B and 2B) of slot 115 as it moves upwards within bore 114. Bolt 120 is thus constrained in a locked position with its lower section 120*m* embedded in the bolt-hole. The door is now secured against potential intruders. As a secondary action, when free end 124*r*2 of toggle-bar 124*r* is swung out of groove 120*g* by spring 124*s* into slot 115 of bore 114, free end 124*r*2 of toggle-bar 124*r* also pushes out release pin 116*p* through pin-hole 116*h* to a partially protruded position.

When bolt 120 is to be unlocked from the bolt-hole, the user presses release pin 116*p* with his/her finger or foot. When release pin 116*p* is pressed, it pushes free end 124*r*2 of toggle-bar 124*r* away from step 115*s* of slot 115 in bore 114 back into groove 120*g* of bolt 120. The reactive force of spring 122 pushes foot pedal 125 and attached bolt 120 upwards. Lower section 120*m* of bolt 120 is thus disembedded from the bolt-hole and the door can be opened. Spring 116*s* may be provided to maintain release pin 116*p* normally in a protruded state.

Figure 4:
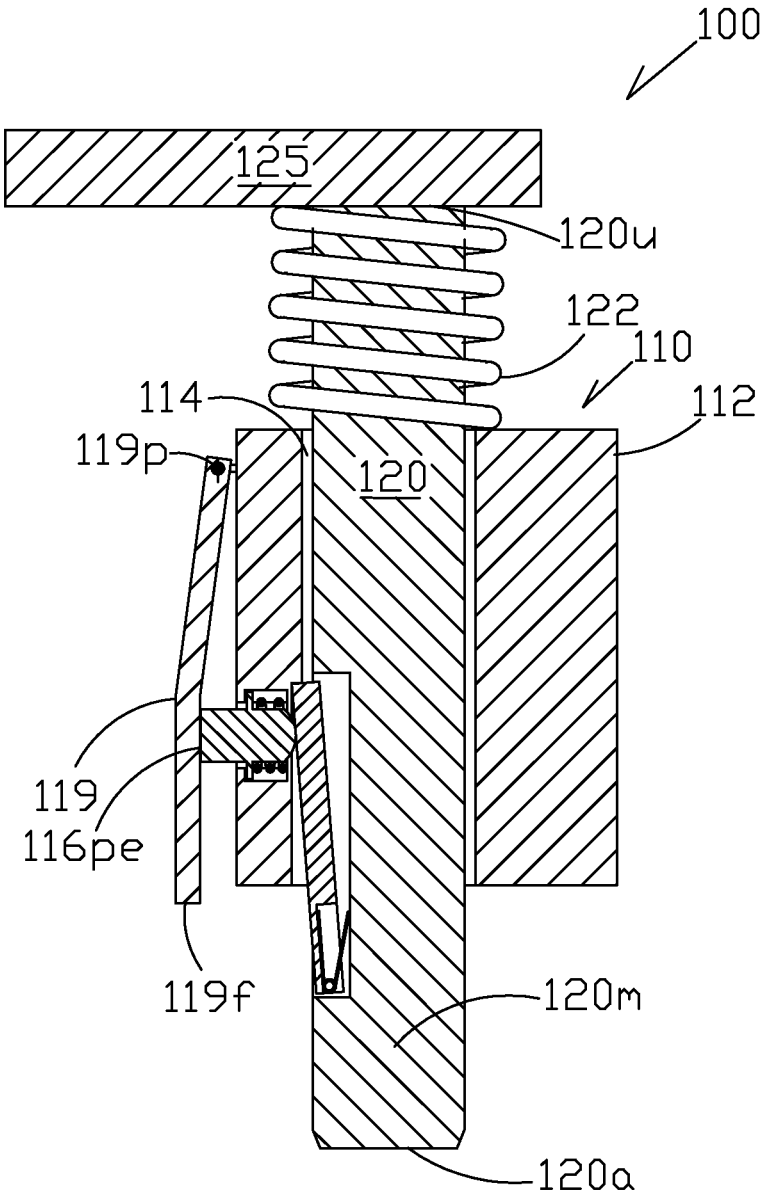
FIG. 4 is a cross-sectional view representation of the QABL with a toggle-lever to facilitate the operation of the unlocking mechanism.

Release pin 116*p* can be pressed manually by the user from within the barricaded area to unlock QABL 100 or can be pressed from outside the room using the Unlocking Tool (described below). Since release pin 116*p* has a rather small contact area, a release lever 119 can be provided as an option (shown in FIG. 4). Release lever 119 has a free end 119*f* which is in contact with protruding end 116*pe* of release pin 116*p*. The second end 119*p* of release lever 119 is pivotingly attached to casing 110. Thus release lever 119 provides a much larger contact area to facilitate unlocking QABL 100 from outside as described in the above paragraph. When free end 119*f* of release lever 119 is pressed, it presses release pin 116*p* to unlock bolt 120 from its locked position as described above.

Figure 5:
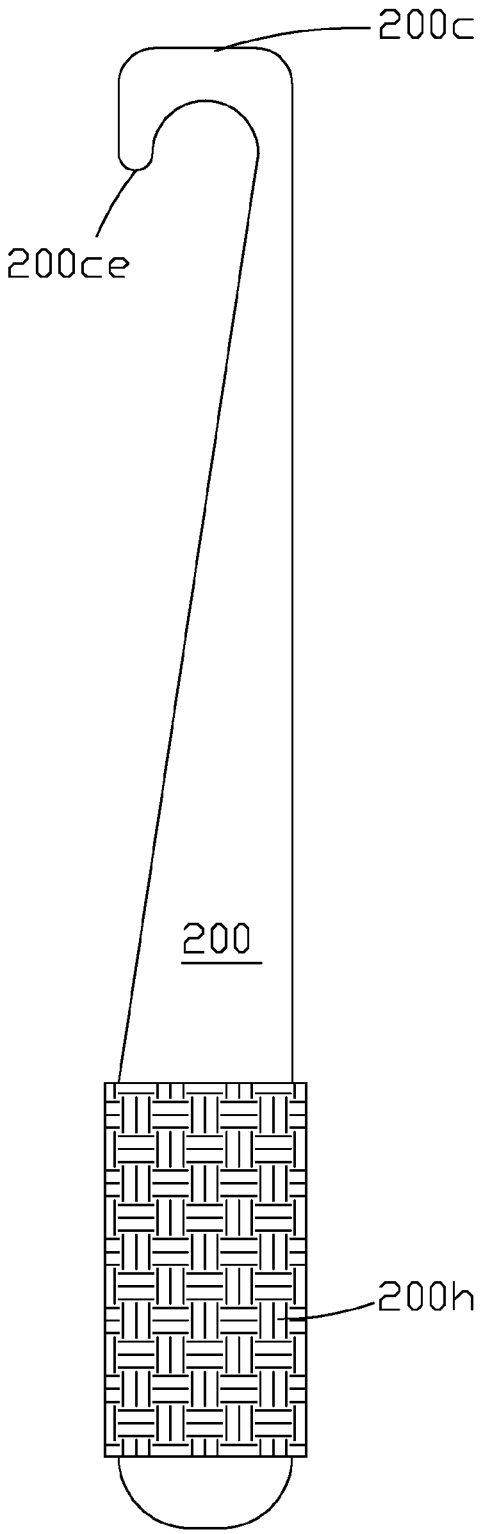
FIG. 5 is a representation of the Unlocking Tool (UT) for unlocking the QABL from outside the room.

QABL 100 can also be unlocked by a rescuer from outside the barricaded area by using an Unlocking Tool which is designed specifically for this purpose. FIG. 5 shows a representation of Unlocking Tool 200 that can be used for this purpose. The tool is configured as a flat, rigid bar 200 with a handle 200*h* at its first end and a crook 200*c* at its second end. The thickness of bar 200 is designed such that it can be inserted through the gap between the door and the floor or door frame.

The user holds the bar by handle 200*h* and then manipulates it until end 200*ce* of crook 200*c* is positioned and contacts protruding end 116*pe* of release pin 116*p* or release lever 119 on QABL 100. The user then pulls on handle 200*h* to press release pin 116*p* or release lever 119 to release bolt 120 from its locked position (described above) to open the door.

Thus QABL 100 does not need a key for it to be opened from the outside. Installation is simple as it does not require a key-hole to be drilled in the door for its operation. It can be quickly and easily installed in any door, preferably at the bottom of the door panel so that it can be quickly and easily activated by the user simply by pressing down on the foot pedal. The EBS can be operated using gross motor skills only.

Thus, in a potentially threatening class-room situation, a teacher can activate the bolt without taking his/her eyes off the students or off the threatening situation. Further, unlocking means 116 is simple enough that even a very young student can operate it to open the door. The QABL is ruggedly built so that it will be difficult for an intruder to physically kick in the door. Also, it will still function if the intruder fires his gun at it. The EBS can be used not only in class-rooms but in every situation where quick action is required for the potential victim to barricade himself or herself. Such situations would include airplane cockpits, offices, safe-rooms, etc.

The preferred embodiment of the EBS has been generally described above in a conceptual manner without detailed dimensions and other engineering data. It will be obvious that persons having ordinary skill in the art can select the design parameters to design the QABL and the Unlocking Tool of the EBS described herein for use in specific situations.

While preferred embodiments of the present invention have been shown and described herein, it will be obvious that such embodiments are provided by way of example only. Numerous variations, changes, and substitutions will occur to those skilled in the art without departing from the invention herein. Accordingly, it is intended that the invention be limited only by the spirit and scope of the following claims.

We claim:

1. An Emergency Barricade System (EBS) for securing a door in a doorway leading to a barricadable area, said EBS comprising:

a casing with a longitudinally oriented bore which has a first open end and a second open end;

means to attach the casing to the surface of the door which is internal to the barricadable area with the longitudinally oriented bore generally perpendicular to the lower edge of the door and the first open end of the bore generally aligned with the edge of the door;

a sliding element (SE) located in the casing's bore which is longer than the bore and has a longitudinal cavity and a first end and a second end, the SE being capable of being moved longitudinally to a engaged position wherein the first end of the SE protrudes through the first open end of the bore to engage a bolt-hole in the doorway;

a foot pedal means which is attached to the second end of the SE to move the SE longitudinally within the bore of the casing;

a return spring means confined between the second open end of the bore of the casing and the foot pedal to normally urge the SE away from the bolt-hole and maintain the SE in a disengaged position;

a locking means to lock the SE in place when the foot pedal means is pressed to move the SE to the engaged position, the locking means comprising a toggle bar and a toggle bar spring, the toggle bar being pivotingly attached at its lower end within the longitudinal cavity of the SE, the toggle bar spring maintaining the free end of the toggle bar in a swung out position towards the inside surface of the bore, the bore further having an engaging surface to engage the free end of the toggle bar in the swung out position and arrest the SE in the engaged position against the action of the return spring means; and an unlocking means which engages the locking means to unlock the SE from the engaged position and allow the return spring means to return the SE to the disengaged position.

2. The EBS of claim 1, wherein the return spring means to hold the SE in the disengaged position is a helical spring which is positioned around the sliding element between the second open end of the bore of the casing and the foot pedal.

3. The EBS of claim 1, wherein the casing has a pin-hole positioned over the free end of the toggle bar in the engaged position and the unlocking means comprises a release pin which slidingly fits in and partially protrudes out of the pin-hole, such that when the protruding end of the pin is pressed, the pin disengages the free end of the toggle bar from the engaging surface of the bore and releases the SE from its engaged position.

4. The EBS of claim 3 further comprising a spring means to return the release pin to its partially protruding position in the pin-hole after it has been pressed to release the SE from its engaged position.

5. The EBS of claim 4 further comprising a toggle lever which is pivotingly fixed to the casing with its free end contacting the protruding end of the release pin such that any applied pressure to the free end of the toggle lever depresses the protruding end of the release pin to release the SE from its engaged position.

6. The EBS of claim 2, wherein the casing has a pin-hole positioned over the free end of the toggle bar in the engaged position and the unlocking means comprises a release pin which slidingly fits in and partially protrudes out of the pin-hole, such that when the protruding end of the pin is pressed, the pin disengages the free end of the toggle bar from the engaging surface of the bore and releases the SE from its engaged position.

7. The EBS of claim 6 further comprising a spring means to return the release pin to its partially protruding position in the pin-hole after it has been pressed to release the SE from its engaged position.

8. The EBS of claim 7 further comprising a toggle lever which is pivotingly fixed to the casing with its free end contacting the protruding end of the release pin such that any applied pressure to the free end of the toggle lever depresses the protruding end of the release pin to release the SE from its engaged position.

9. The EBS of claim 1 further comprising a tool means to operate the unlocking means from the outside of the barricadable area, the tool means being dimensionally configured for insertion in a gap between the closed door and the doorway, the tool means having an engaging means at its insertion end to engage the unlocking means.

10. The EBS of claim 9 wherein the tool means is a flat bar and the engaging means is a crook at its insertion end which engages the unlocking means.

11. The EBS of claim 2 further comprising a tool means to operate the unlocking means from the outside of the barricadable area, the tool means being dimensionally configured for insertion in a gap between the closed door and the doorway, the tool means having an engaging means at its insertion end to engage the unlocking means.

12. The EBS of claim 11 wherein the tool means is a flat bar and the engaging means is a crook at its insertion end to engage the unlocking means.

13. The EBS of claim 3 further comprising a tool means to operate the unlocking means from the outside of the barricadable area, the tool means being dimensionally configured for insertion in a gap between the closed door and the doorway, the tool means having an engaging means at its insertion end which depresses the protruding end of the release pin.

14. The EBS of claim 13 wherein the tool means is a flat bar and the engaging means is a crook at its insertion end to depress the protruding end of the release pin.

15. The EBS of claim 6 further comprising a tool means to operate the toggle lever from the outside of the barricadable area, the tool means being dimensionally configured for insertion in a gap between the closed door and the doorway, the tool means having an engaging means at its insertion end to engage the toggle lever.

16. The EBS of claim 15 wherein the tool means is a flat bar and the engaging means is a crook at its insertion end which engages the toggle lever.

17. The EBS of claim 8 further comprising a tool means to operate the toggle lever from the outside of the barricadable area, the tool means being dimensionally configured for insertion in a gap between the closed door and the doorway, the tool means having an engaging means at its insertion end to engage the toggle lever.

18. The EBS of claim 17 wherein the tool means is a flat bar and the engaging means is a crook at its insertion end which engages the toggle lever.

19. An Emergency Barricade System (EBS) for securing a door in a doorway leading to a barricadable area, said EBS comprising:

a casing with a longitudinally oriented bore which has a first open end and a second open end;

means to attach the casing to the surface of the door which is internal to the barricadable area with the longitudinally oriented bore generally perpendicular to the lower edge of the door and the first open end of the bore generally aligned with the edge of the door;

a sliding element (SE) located in the casing's bore which is longer than the bore and has a first end and a second end, the SE being capable of being moved longitudinally to a engaged position wherein the first end of the SE protrudes through the first open end of the bore to engage a bolt-hole in the doorway;

a return spring means confined between the second open end of the bore of the casing and the second end of the SE to normally urge the SE away from the bolt-hole and maintain the SE in a disengaged position;

a locking means to lock the SE in place when the second end of the SE is pressed to move the SE to the engaged position, the locking means located totally within the bore of the casing and engaging the SE and the inside surface of the bore to arrest the SE in the engaged position against the action of the return spring means; and an unlocking means which engages the locking means to unlock the SE from the engaged position and allow the return spring means to return the SE to the disengaged position.

20. The EBS of claim 19 wherein the locking means is attached to the SE and engages the inside surface of the bore to arrest the SE in the engaged position.

21. An Emergency Barricade System (EBS) for securing a door in a doorway leading to a barricadable area, the EBS comprising:

a casing with a longitudinally oriented bore which has a first open end and a second open end;

means to attach the casing to the surface of the door which is internal to the barricadable area with the longitudinally oriented bore generally perpendicular to the lower edge of the door and the first open end of the bore generally aligned with the edge of the door;

a sliding element (SE) located in the casing's bore which is longer than the bore and has a first end and a second end, the SE being capable of being moved longitudinally to a engaged position wherein the first end of the SE protrudes through the first open end of the bore to engage a bolt-hole in the doorway;

a foot pedal means which is attached to the second end of the SE to move the SE longitudinally within the bore of the casing;

a return spring means confined between the second open end of the bore of the casing and the foot pedal to normally urge the SE away from the bolt-hole and maintain the SE in a disengaged position;

a locking means to lock the SE in place when the foot pedal means is pressed to move the SE to the engaged position, the locking means located totally within the bore of the casing and the locking means is attached to the SE and engages the inside surface of the bore to arrest the SE in the engaged position against the action of the return spring means; and an unlocking means which engages the locking means to unlock the SE from the engaged position and allow the return spring means to return the SE to the disengaged position.

* * * * *